US009563163B2

(12) United States Patent
Tanaka et al.

(10) Patent No.: US 9,563,163 B2
(45) **Date of Patent: *Feb. 7, 2017**

(54) IMAGE FORMING APPARATUS

(71) Applicant: CANON KABUSHIKI KAISHA, Tokyo (JP)

(72) Inventors: Kenichi Tanaka, Abiko (JP); Taiya Hirayama, Moriya (JP); Shutaro Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/722,279

(22) Filed: May 27, 2015

(65) Prior Publication Data

US 2015/0346664 A1 Dec. 3, 2015

(30) Foreign Application Priority Data

May 29, 2014 (JP) ..... 2014-111046
Apr. 3, 2015 (JP) ..... 2015-076664

(51) Int. Cl.
*G03G 15/00* (2006.01)
*G03G 15/20* (2006.01)
*G03G 21/16* (2006.01)

(52) U.S. Cl.
CPC ..... *G03G 15/502* (2013.01); *G03G 15/2042* (2013.01); *G03G 21/1685* (2013.01); *G03G 2215/00447* (2013.01)

(58) Field of Classification Search
CPC ..... G03G 15/5016; G03G 2215/20
See application file for complete search history.

(56) References Cited

U.S. PATENT DOCUMENTS 7,262,391 B2 8/2007 Nishihara et al.
7,890,024 B2 2/2011 Hirayama et al.
(Continued)

FOREIGN PATENT DOCUMENTS

JP 2008-040365 2/2008
JP 2011-056945 A 3/2011
JP 2012-234016 A 11/2012

OTHER PUBLICATIONS

Shutaro Saito et al., U.S. Appl. No. 14/721,206, filed May 26, 2015.
(Continued)

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes: a display portion; an image forming device; a fixing device; a controller configured to control display of the display portion so that one is selected from a plurality of sheet widths to impose a limitation on a use of the image forming apparatus; a storing portion, provided detachably mountable to the image forming apparatus together with the fixing device, configured to store information corresponding to the sheet width selected at the display portion; a reading portion configured to read information stored in the storing portion; and a limiting portion configured to impose, on the basis of the information read by the reading portion, a limitation on widths of sheets capable of being designated as a printing condition.

29 Claims, 6 Drawing Sheets

(56) References Cited

U.S. PATENT DOCUMENTS

| | | | | |
|---|---|---|---|---|
| 7,890,038 | B2 | 2/2011 | Chikugo et al. | |
| 8,655,242 | B2 | 2/2014 | Tanaka | |
| 8,779,335 | B2 | 7/2014 | Saito | |
| 8,942,612 | B2 | 1/2015 | Tanaka | |
| 8,958,716 | B2 | 2/2015 | Saito | |
| 9,069,299 | B2 | 6/2015 | Tanaka | |
| 2011/0058201 | A1 | 3/2011 | Mueller | |
| 2013/0077114 | A1* | 3/2013 | Short | G03G 15/6552 358/1.13 |
| 2013/0142534 | A1* | 6/2013 | Isobe | G03G 15/20 399/67 |
| 2014/0064765 | A1* | 3/2014 | Kitamoto | G03G 15/5016 399/69 |
| 2014/0153938 | A1 | 6/2014 | Saito | |
| 2015/0185670 | A1 | 7/2015 | Tanaka | |

OTHER PUBLICATIONS

Taiya Hirayama et al., U.S. Appl. No. 14/721,344, filed May 26, 2015.

Kenichi Tanaka et al., U.S. Appl. No. 14/722,503, filed May 27, 2015.

* cited by examiner

IMAGE FORMING APPARATUS

FIELD OF THE INVENTION AND RELATED ART

The present invention relates to an image forming apparatus for forming a toner image on a sheet. Examples of the image forming apparatus may include, e.g., a copying machine, a printer, a facsimile machine and a multi-function machine having a plurality of functions of these machines.

In a conventional image forming apparatus of an electrophotographic type, the fixing device for fixing a toner image formed on a recording material (sheet) by using an electrophotographic process is mounted. This fixing device has a constitution in which the toner image is heated while nipping and feeding the recording material at a nip formed by a pair of rotatable members, e.g., a fixing roller and a pressing roller.

A state of a surface of the fixing roller has an influence on glossiness of an image, and therefore it has become important more than ever that a surface property of the fixing roller is stably maintained. However, when a side edge of the recording material continuously contacts the fixing roller at the same position, there is a tendency that a surface property at a portion thereof (contact portion) is inferior to that at another portion.

It would be considered that this is because the side edge of the recording material has a minutely bent (flexed) shape during manufacturing thereof, i.e., during cutting.

In such a background, when recording materials having the same width are continuously introduced into the fixing device, fixing roller potions contacting both side edges of the recording materials are damaged (also referred to as fixing device).

In such a state that the edge damage is generated on the fixing roller surface, when the image is formed on a recording material wider than the above recording materials, there is a liability that glossiness of the image at a portion corresponding to the edge damage is lowered compared with that at another portion and thus uneven glossiness is generated on the image.

Therefore, in an apparatus (device) described in Japanese Laid-Open Patent Application (JP-A) 2008-040365, the generation of uneven glossiness on the image is suppressed by rubbing the fixing roller surface with a roughening roller to level out the surface property of the fixing roller with respect to a longitudinal direction of the fixing roller, and therefore this method is an excellent method satisfactory to a general user.

However, in the method described in JP-A 2008-040365, it is difficult to completely eliminate the uneven glossiness of the image, and in the case where a required level by the user with respect to uniformity of the glossiness of the image is very high, it is difficult to deal with the uneven glossiness by using such a method.

SUMMARY OF THE INVENTION

According to an aspect of the present invention, there is provided an image forming apparatus comprising: a display portion configured to produce a display for designating a printing condition by an operator; an image forming device configured to form a toner image on a sheet depending on the printing condition designated at the display portion; a fixing device configured to fix the toner image, formed on the sheet by the image forming device, by heat and pressure; a controller configured to control display of the display portion so that one is selected from a plurality of sheet widths to impose a limitation on a use of the image forming apparatus; a storing portion, provided detachably mountable to the image forming apparatus together with the fixing device, configured to store information corresponding to the sheet width selected at the display portion; a reading portion configured to read the information stored in the storing portion; and a limiting portion configured to impose, on the basis of the information read by the reading portion, a limitation on widths of sheets capable of being designated as the printing condition.

According to another aspect of the present invention, there is provided an image forming apparatus comprising: a display portion configured to produce a display for designating a printing condition by an operator; an image forming device configured to form a toner image on a sheet depending on the printing condition designated at the display portion; a fixing device configured to fix the toner image, formed on the sheet by the image forming device, by heat and pressure; a controller configured to control display of the display portion so that one is selected from a plurality of sheet widths to impose a limitation on a use of the image forming apparatus; and a limiting portion configured to impose, on the basis of the information corresponding to the sheet width selected at the display portion, a limitation on widths of sheets capable of being designated as the printing condition.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described, but although the following embodiments are examples of preferred embodiments, the present invention is not limited to the following embodiments.

Embodiment 1

General Structure of Image Forming Apparatus

Figure 2:
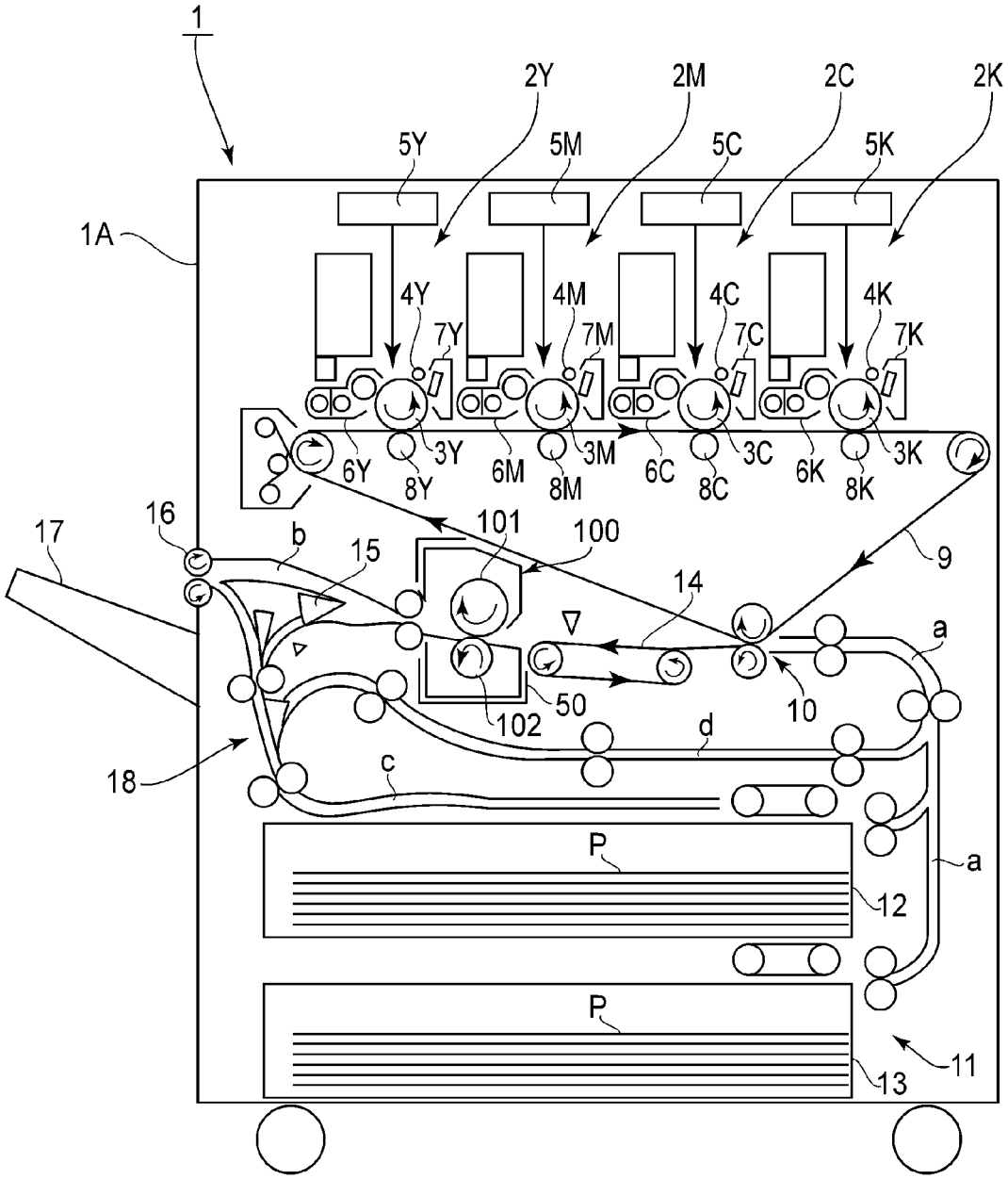
FIG. 2 is a schematic view showing a structure of the image forming apparatus.

FIG. 2 is a schematic view showing a general structure of an image forming apparatus 1 in this embodiment. This image forming apparatus 1 is an electrophotographic full-color printer which is of an intermediary transfer type and which has a both-side image forming function. Inside an apparatus main assembly (image forming apparatus main assembly) 1A of the image forming apparatus 1, e.g., four image forming portions 2Y, 2M, 2C and 2K corresponding to Y (yellow), M (magenta), C (cyan) and K (black) are disposed in series as an image forming device. That is, as the image forming device, a tandem type in which a process until a visible image is formed is performed in parallel among the respective colors of Y, M, C and K is employed.

In order to prevent cumbersome description, the four image forming portions for the respective colors of Y, M, C and K will be described by representing these portions as a symbol "2", and this is similarly applied to the following associated process means. Further, the order of arrangement of the image forming portions 2 for the respective colors of Y, M, C and K is not limited to the above order.

At each of the image forming portions 2, the following respective electrophotographic process means are provided. That is, a photosensitive member (image bearing member) 3 for bearing an electrostatic latent image on a surface thereof correspondingly to an associated one of the colors of Y, M, C and K, a primary charger 4, an exposure device 5, a developing device 6 and a cleaning device 7 are provided.

The primary charger 4 electrically charges the surface of an associated photosensitive member 3 uniformly by applying a charging bias voltage having a set potential. The surface of the photosensitive member 3 is exposed to light by the exposure device 5 correspondingly to an image information pattern, so that the electrostatic latent image is formed. The electrostatic latent image is developed with a toner (developer) by the developing device 6, thus being changed into a visible image as a toner image.

Toner images of the respective colors of Y, M, C and K which are formed and carried on the surfaces of the photosensitive members 3 of the respective image forming portions 2 are successively primary-transferred superposedly onto an endless belt as an intermediary transfer member 9 by a primary transfer device 8. A primary transfer residual toner on each of the photosensitive members 3 is removed by the cleaning device 7.

An unfixed full-color toner image formed on the intermediary transfer member 9 by superposing the toner images of all the colors of Y, M, C and K is collectively secondary-transferred by a secondary transfer device 10 onto a recording material (sheet) P as a recording medium fed from a feeding portion 11 to the secondary transfer device 10.

The recording material (hereinafter referred to as a sheet) P is an image formable sheet-like member and may include plain paper, glossy paper, a resin-made sheet such as an OHP sheet, thick paper, an envelope, a postcard, a label or the like. In the image forming apparatus 1 in this embodiment, the feeding portion 11 includes sheet cassettes 12 and 13 as upper and lower cassette portions each accommodating sheets P. Further, a feeding member for the sheet cassette accommodating sheets P having a width selected and designated in advance is driven, so that the sheets P in the cassette are separated and fed one by one to the secondary transfer device 10 through a feeding path a.

The width of the sheet P is a sheet dimension with respect to a direction perpendicular to a sheet feeding direction X (FIG. 1) on a sheet surface. In the image forming apparatus 1 in this embodiment in this embodiment, independently of the width of the sheet P, the sheet P is introduced into a fixing device (fixing apparatus) 100 so that a center position of the sheet P with respect to a width direction of the sheet P substantially coincides with a center position of the fixing device 100 with respect to the width direction of the fixing device 100.

The sheet P passed through the secondary transfer device 10 is separated from the intermediary transfer member 9 and is guided by a feeding device 14 into the fixing device 100 as an image heating apparatus. The fixing device 100 applies heat and pressure to the unfixed toner image while nipping and feeding the sheet P, thus fixing the toner image as a fixed image as described later.

In the case of a one-side image forming mode, the sheet P coming out of the fixing device 100 is changed in course to a feeding path b side by a flag 15, and is discharged, as a full-color image-formed product (resultant product) on which the image is formed on one surface, onto a discharging tray 17.

In the case of a double-side image forming mode, the sheet P which comes out of the fixing device 100 and on which the image has already been formed on a first surface is changed in course to a double-side feeding path mechanism 18 side by the flag 15. Then, the sheet P is fed in a switch-back manner after being fed into a feeding path c of the mechanism 18, and is fed again into the feeding path a via a feeding path d in an upside-down state, thus being fed to the secondary transfer device 10. As a result, the secondary transfer of the toner image from the intermediary transfer member 9 onto a second surface of the sheet P is made.

Therefore, similarly as in the case of the one-side image forming mode, the sheet P is fed through a course in the order of the feeding device 14, the fixing device 100, the feeding path b and a discharging roller pair 16, and is discharged, as a full-color image-formed product (resultant product) on which the image is formed on both (first and second) surfaces, onto the discharging tray 17.

(Fixing Device)

Figure 1:
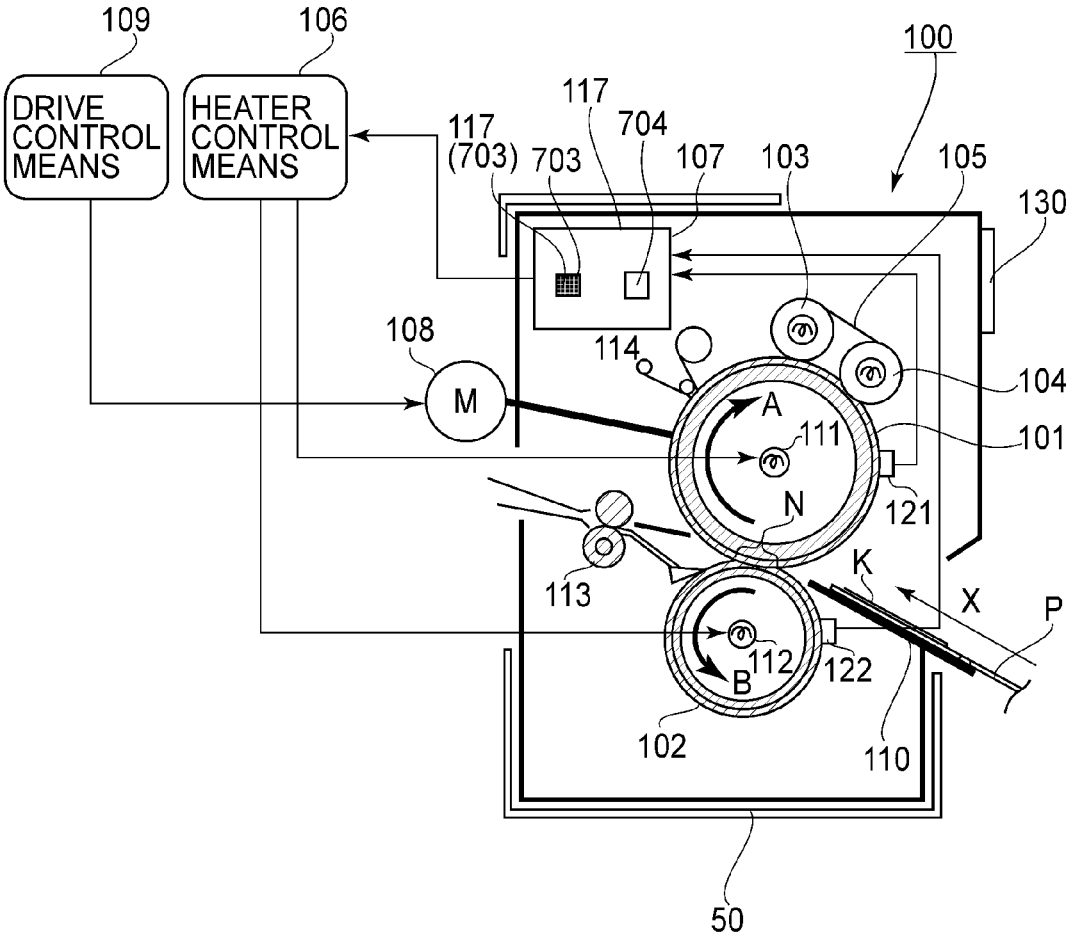
FIG. 1 is a schematic enlarged view of a fixing device portion.

FIG. 1 is an enlarged schematic view of the fixing device 100 portion of the image forming apparatus 1 shown in FIG. 2. The fixing device 100 is detachably mounted as a fixing unit in a mounting portion (fixing device mounting portion) 50 of the apparatus main assembly 1A of the image forming apparatus 1 in a predetermined manner (procedure). In a state in which the fixing device 100 is mounted so as to be positioned and fixed to the mounting portion 50 of the apparatus main assembly 1A of the image forming apparatus 1 in a predetermined manner, the fixing device 100 is electrically and mechanically connected with a controller, an electric power supplying portion, a driving mechanism portion and the like in the apparatus main assembly 1A side in a predetermined manner, thus receiving supplied electric power and a driving force from the apparatus main assembly 1A side.

The fixing device 100 includes a pair of rotatable members for forming a nip (fixing nip) N where the sheet P carrying thereon an unfixed toner image K is nipped and fed, i.e., a fixing roller (rotatable fixing member) 101 and a pressing roller (rotatable display member, rotatable opposite member) 102. Further, the fixing device 100 includes an external heating belt 105, as a mechanism for heating the fixing roller 101 from an outside thereof, rotatably stretched by supporting first and second rollers 103 and 104. Further, the fixing device 100 includes a web cleaning device 114 for cleaning the surface of the fixing roller 101.

The fixing roller 101 is prepared by forming a parting layer of a heat-resistant resin material on an outer peripheral surface of a core metal and is rotationally driven in the clockwise direction of an arrow A at a predetermined peripheral speed by a driving motor (driving mechanism)

108 controlled with respect to a rotational speed by a drive control means (motor controller) 109. Inside the core metal of the fixing roller 101, a halogen heater 111 as an internal heat generating element is provided, and heats the fixing roller 10 in combination with the external heating belt 105 so that a surface temperature of the fixing roller 101 is a predetermined temperature.

The pressing roller 102 is prepared by forming a heat-resistant elastic layer on an outer peripheral surface of a core metal, and is disposed in parallel to the fixing roller 101. Further, by an unshown pressing means, the pressing roller 102 is pressed toward the fixing roller 101 at a predetermined pressure against elasticity of the elastic layer, so that the fixing nip N having a predetermined width with respect to the feeding direction X of the sheet P is formed between itself and the fixing roller 101.

The pressing roller 102 is rotated by the rotational drive of the fixing roller 101 in the counterclockwise direction of an arrow B at a peripheral speed corresponding to the peripheral speed of the fixing roller 101. Inside the core metal of the pressing roller 102, a halogen heater 112 as the heat generating element is provided, so that the pressing roller 102 is heated from an inside thereof so that a surface temperature of the pressing roller 102 is a predetermined temperature.

The surface temperature of the fixing roller 101 is detected by a thermistor 121 as a temperature detecting means contacting the fixing roller 101. The surface temperature of the pressing roller 102 is detected by a thermistor 122 contacting the pressing roller 102. Electrical signals relating to the temperatures outputted from the thermistors 121 and 122 are once collected by a fixing device substrate (electrostatic circuit substrate) 107 provided in the fixing device 100, and thereafter are inputted into a heater control means 106 as a temperature control (adjusting) means.

The heater control means 106 turns on and off the respective halogen heaters 111 and 112 on the basis of detected temperatures of the thermistors 121 and 122, respectively, so that the heater control means 106 controls the heaters so that each of the surface temperature of the fixing roller 101 and the surface temperature of the pressing roller 102 is the predetermined temperature.

The fixing device substrate 107 also has the following functions in addition to the temperature detection of the thermistors 121 and 122. That is, the fixing device substrate 107 also has the function of controlling drive of a motor for operating an unshown pressing means and the function of collecting signal lines and power lines which are used for operating a sensor for detecting positions (pressing state position and pressing-eliminated state position) of the pressing means.

The rotational drive of the fixing roller 101 and the following rotation of the pressing roller 102 with the rotation drive of the fixing roller 101 are made, and the surface temperatures of both of the rollers are increased up to the predetermined temperatures, so that temperature control is made. In this fixing device state, the sheet P which passed through the secondary transfer device 10 and which is fed into the fixing device 100 by the feeding device 14 is guided by a guiding member 110 into the nip N, and is nipped and fed. A carrying surface of the sheet P which is to be guided into the nip N and which carries the unfixed toner image K is directed upward, and faces the fixing roller 101.

In this way, by nipping and feeding the sheet P through the nip N, the unfixed toner image K is fixed as the fixed image on the surface of the sheet (recording material) P under application of heat and pressure. The sheet P coming-out of the nip N is separated from the fixing roller 101 and the pressing roller 102, and is sent from the inside of the fixing device 100 by a discharging roller pair 113 for the fixing device 100. The web cleaning device 114 wipes and removes an offset toner on the surface of the fixing roller 101. The external heating means (103, 104, 105) is provided upstream of the nip N and downstream of the web cleaning device 114 with respect to the fixing roller rotational direction.

In this embodiment, on the substrate 107 of the fixing device 100, a holding portion 117 for holding information (fixing device discrimination information) for imposing a limitation on a use of the fixing device 100 is mounted. In this embodiment, this holding portion 117 is a nonvolatile memory (storing portion) represented by ROM, RAM, flash memory or the like.

In this embodiment, the above information is information corresponding to a specific width of the recording material capable of being introduced into the fixing device, and the information is stored (held) in a storing region 703 of the memory 117. That is, in the storing region 703, width information of the sheet to be subjected to image formation (a width of the sheet with respect to a direction perpendicular to the feeding direction X and is hereinafter referred to as an exclusive width) can be stored. This function is used when a user cannot allow an image defect due to edge damage in the case where a sheet different in width is introduced into the fixing device 100.

Accordingly, in the image forming system in this embodiment, a plurality of fixing devices 100 to which the specifications are common are prepared. Therefore, in the case where the image is intended to be formed on the sheet having the exclusive width, exchange and mounting (replacement) of the fixing device 100 are performed. As a result, with respect to the sheet having the exclusive width, it becomes possible to prevent generation of the image defect due to the edge damage with reliability.

Further, in a counter storing region 704 of the memory 117, an integrated value (exchange parts counter: current durability state) of a sheet number (the number of sheets subjected to image formation) for each of various parts required to be periodically exchanged in the image forming apparatus 1 or the fixing device 100 is recorded by the controller 700. This will be described later.

(Control Device)

Figure 3:
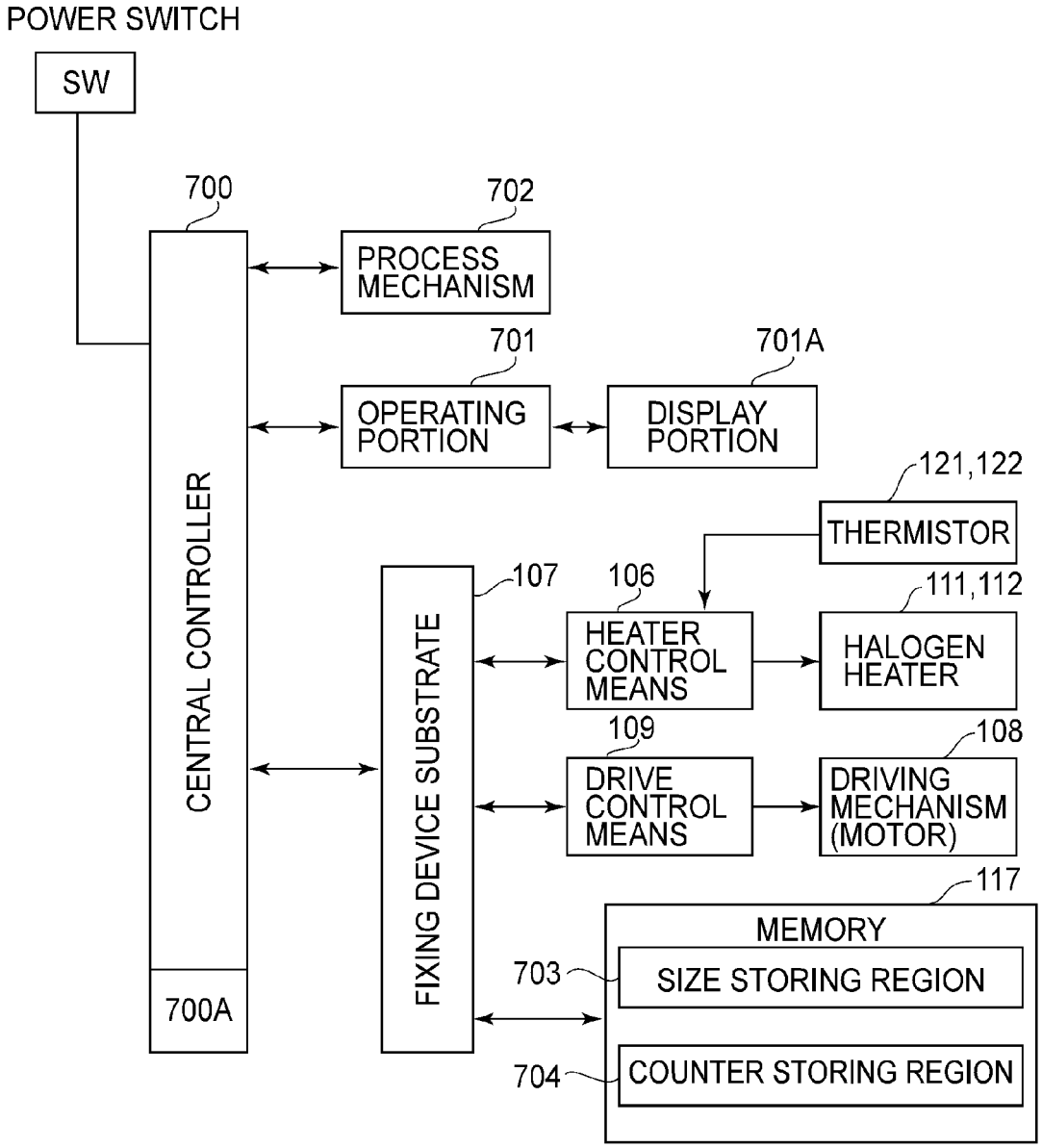
FIG. 3 is a block diagram of an outline of a control system.

FIG. 3 is a block diagram of an outline of a control system of the image forming apparatus 1. A general printing operation (image forming operation) of an image forming process mechanism 702 of the image forming apparatus 1 is controlled by a central controller 700 controlled by CPU.

Figure 4:
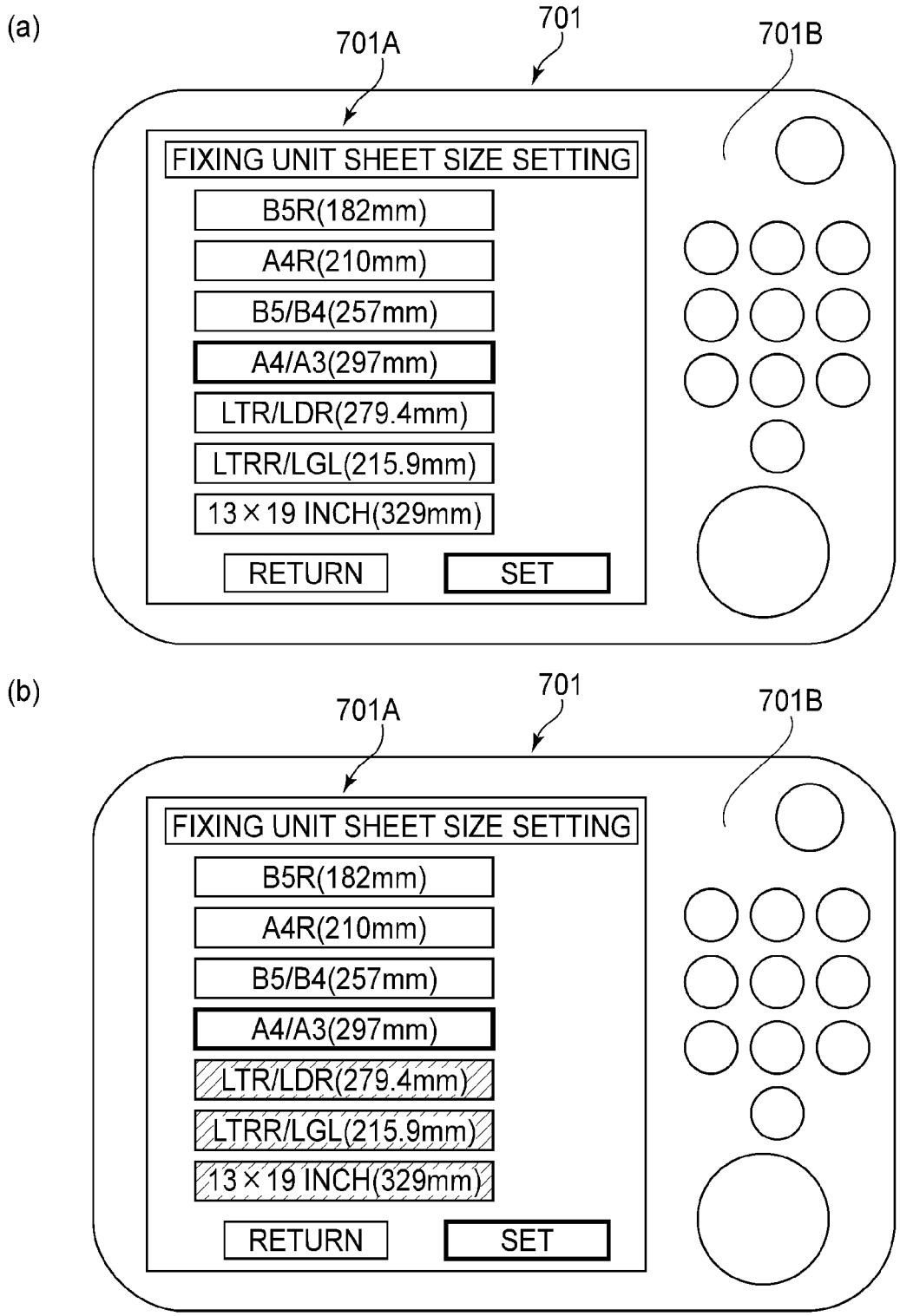
In FIGS. 4, (*a*) and (*b*) are illustrations each showing a screen in which an exclusive width is set for a fixing device through a display portion of an operating potion.

An operating portion 701 functions as a means for inputting/designating a printing condition. The operating portion 701 includes a display portion (information display portion) 701A and an operating button portion 701B as shown in FIG. 4. At the operating button portion 701B, conditions (various settings) of the printing performed by the image forming apparatus 1 are inputted. The display portion 701A is a liquid crystal screen of a touch panel type, and at the display portion 701A, not only information display of various messages or the like but also display of various operation buttons (keys) are made by the controller. Also by the displayed operation buttons, (keys) designation of the conditions (various settings) of the printing is made by the operator. Incidentally, the printing operation for performing the printing (image formation) includes at least one of species of sheets and the number of sheets.

The fixing device substrate 107 is in an electrically connected state with the controller 700 of the apparatus main assembly 1A side in a state in which the fixing device 100 is mounted in the mounting portion 50 of the apparatus main assembly 1 in a predetermined manner. Further, an information reading function portion (reading portion) 700A of the controller 700 can read information (sheet width), for imposing a limitation on a user of the fixing device, stored in advance in the size storing region 703 of the memory 117 of the fixing device substrate 107. In this embodiment, the exclusive width set for the mounted fixing device 100 can be read.

The controller 700 controls the image forming operation of the image forming apparatus 1 on the basis of a discrimination result of a discriminating portion 700A (change in control) relating to the fixing device.

Further, the controller 700 counts the number of passed sheets fed by execution of the image forming operation of the image forming apparatus 1. Then, the controller 700 writes and records the integrated value of the number of sheets for each of various parts required to be periodically exchanged in the image forming apparatus 1 and the fixing device 100 while updating (renewing) the integrated value in the counter storing region 704 of the memory 117. (Setting method of sheet size information)

A method of setting the sheet size (exclusive width information) or changing setting of the sheet size information in the size storing region 703 of the memory 117 as a storing portion provided in the fixing device 100 will be described. This setting or setting change can be made through the operating portion 701 in a state in which the fixing device 100 is mounted in the mounting portion 50 of the apparatus main assembly 1A.

At the display portion 701A of the operating portion 701, a sheet width setting screen can be displayed through a screen selection operation by the controller as shown in (a) of FIG. 4. Through this sheet setting screen, the operator can make the setting or setting change of the exclusive width in the size storing region 703 of the memory 117 of the fixing device 100 mounted in the mounting portion 50 of the apparatus main assembly 1A.

In the case where the fixing device 100 is a new one in an unused state, the setting of the exclusive width is not made in the size storing region 703 of the memory 117. Further, at this time, a recording value of the integrated value (exchange parts counter) of the number of passed sheets for each of the periodical exchange parts for the fixing device 100 in the counter storing region 704 of the memory 117 is "0".

The setting of the exclusive width of the new fixing device 100 is as follows. In the case where this fixing device 100 is mounted in the mounting portion 50 of the apparatus main assembly 1A, the discriminating portion 700A makes discrimination by information reading from the memory 117 that the exclusive width is not set and that the integrated value of the number of passed sheets is "0". In this case, when the user displays the sheet width setting screen at the display portion 701A of the operating portion 701 by the screen selection operation, the controller 700 displays such a screen as shown in (a) of FIG. 4.

Therefore, the operator (user) pushes a button of, e.g., "A4/A3 width (297 mm)" size and then pushes a button of "SET" in the sheet width setting screen. As a result, a set value of the A4/A3 width (297 mm) size is written as the exclusive width from the controller 700 into the size storing region 703 of the memory 117 of the fixing device 100 currently mounted in the apparatus main assembly 1A. Incidentally, the setting of the exclusive width is not limited to setting of the above A4/A3 width (297 mm) size, but can be made as setting of various exclusive widths in the sheet width setting screen.

By this setting of the exclusive width, in the state in which the fixing device 100 is mounted in the mounting portion 50 of the apparatus main assembly 1A, the fixing device 100 is discriminated, by the discriminating portion 700A of the controller, as a fixing device exclusively used for the A4/A3 width. The sheet size information written in the size storing region 703 is data written in the memory 117, and therefore is maintained even when the fixing device 100 is demounted from the apparatus main assembly 1A.

In this embodiment, when the fixing device 100 for which the setting of the exclusive width is made is mounted in the mounting portion 50 of the apparatus main assembly 1A as described above, the exclusive width set in the memory 117 is discriminated by the discriminating portion 700A. Then, on the basis of a discrimination result of the discriminating portion 700A, in the sheet size selection screen (FIG. 5) for designating the printing condition, the controller 700 disables selection of sheets having widths other than the width corresponding to the exclusive widths. Specifically, with respect to the sheets having the widths other than the exclusive width, the sheet sizes are greyed out for display, so that the selection is disabled.

That is, the user can freely set, depending on user's needs, a general-purpose fixing device (a common-specification fixing device capable of being limited to that for any width sheet) as a fixing device, depending on each of sheet sizes, such as "A4/A3 size-exclusive fixing device" or "A4R size-exclusive fixing device". In addition, information thereof is held in the holding portion 117 of the fixing device 100. Therefore, even in the case where the fixing device in which the exclusive width is recorded in the memory is once demounted from the apparatus and then is mounted again in the apparatus, it becomes possible to prevent generation of the image defect due to the edge damage.

Next, the case where at the time when the fixing device 100 for which setting of an exclusive width having a certain width is made is used for some time and then the edge damage is generated on the fixing roller 101, the setting is accidentally changed from the exclusive width to an exclusive width larger in width than the exclusive width will be considered. In this case, the image defect due to the edge damage generating on the surface of the fixing roller 101 can generate.

Therefore, in the case where for the fixing device 100 used for some time in this way, setting of the exclusive width is changed din a direction of increasing the exclusive width, the fixing roller 101 is exchanged with a new one (or, is exchanged with a new one in the form of a new fixing device). Then, the integrated value (counter) of the number of passed sheets for the fixing roller 101 in the counter storing region 704 of the memory 117 is reset. Only at the time when such a manner is employed, for the fixing device 100, the exclusive width can be arbitrarily changed in setting not only in the increasing direction but also in a decreasing direction. As a result, in the case where the setting of the exclusive width is intended to be changed in the increasing direction, a problem of the edge damage can be solved. This will be described later.

On the other hand, the case where at the time when the fixing device 100 for which the setting of the exclusive width having the certain width is made is used for some time and then the edge damage is generated on the fixing roller 101, the setting is changed from the exclusive width to an exclusive width smaller in width than the exclusive width will be considered. In this case, the problem of the image defect due to the edge damage generating on the surface of the fixing roller 101 does not generate.

Accordingly, in the case where for the fixing device 100 used for some time, setting of the exclusive width is changed in a direction of decreasing the exclusive width, the setting change is enabled when the integrated value (counter) of the number of passed sheets for the fixing roller 101 in the counter storing region 704 of the memory 117 is reset. As a result, it is possible to enhance a degree of freedom of the change in setting of the exclusive width while avoiding the generation of the image defect due to the edge damage.

Such a setting change is made in the following manner. In a state in which the fixing device 100 is mounted in the mounting portion 50 of the apparatus main assembly 1A, a counter display screen (FIG. 6) for each of the exchange parts is displayed at the display portion 701A of the operating portion 701. Then, as described later, the integrated value (counter) of the number of passed sheets for the fixing roller 101 in the counter storing region 704 of the memory 117 is reset. Then, the sheet size setting screen ((b) of FIG. 4) is displayed through the screen selection operation at the display portion 701A of the operating portion 701.

An example in which setting of the exclusive width for the fixing device 100 exclusively used for the A4/A3 size is changed will be described. When the sheet P is used in the fixing device exclusively used for the A4/A3 size, the edge damage generates at positions corresponding to both side edge portions of the sheet having the A4/A3 width. For that reason, when the setting change of the exclusive width is made so that the exclusive width is changed to a sheet width wider than the A4/A3 width, the above-described edge damage generating on the surface of the fixing roller constitutes a factor of the image defect. Therefore, in this case, in the sheet width setting screen displayed at the display portion 701A of the operating portion 701, as shown in (b) of FIG. 4, gray-out display is made so that a sheet width not less than the A4/A3 size cannot be selected.

At the display portion 701A, by the controller 700, display is made so that selection/designation is permitted with respect to a sheet having a size not more than the A4/A3 width. In the example of (b) of FIG. 4, selection is enabled with respect to 3 widths of B5R, A4R and B5/B4. However, after a limitation on the width is improved once and then the image formation is effected, with respect to the change in width of the sheet to the widths not less than the set exclusive width, as described above, a prohibited case and a permitted case can occur.

This is summarized as follows. The size of the sheet P capable of being introduced into the fixing device 100 is settable from the operating portion 701. The controller 700 records the integrated value of the number of introduced sheets as the number of times of use of the fixing roller in the memory 117, and the recorded integrated value is resettable by the operating portion 701. With respect to a set value, of the sheet width, once set in the memory 117 of the fixing device 100, the setting change in the direction of decreasing the width can be made only when the integrated value is reset.

Figure 5:
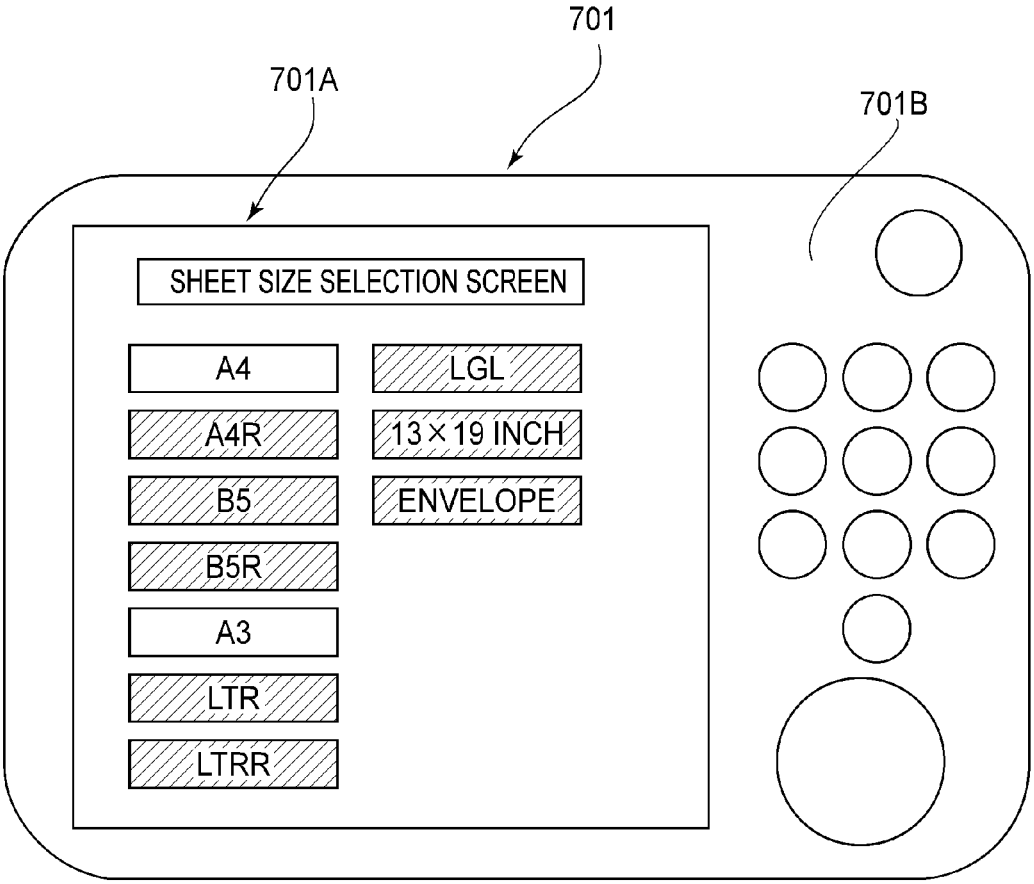
FIG. 5 is an illustration showing a sheet size setting screen displayed at the display portion of the operating portion when the fixing device for which the exclusive width is set is mounted.

FIG. 5 shows the sheet size selection screen displayed through the screen selection operation at the display portion 701A of the operating portion 701 in the state in which the fixing device 100 for which the exclusive width has already been set is mounted in the mounting portion 50 of the apparatus main assembly 1A. In an example of FIG. 5, the case where the fixing device 100 for which setting of the A4/A3 width (297 mm) is set is mounted in the mounting portion 50 of the apparatus main assembly 1A is shown. The exclusive width of the fixing device 100 is set at the A4/A3 width (297 mm), and therefore in the sheet size selection screen at the display portion 701A for setting/designating the printing condition, buttons (keys) for selecting sheets having widths other than the A4/A3 width are displayed in a gray-out manner, so that control is effected so as not to make selection/setting.

As a result, sheets having widths not more than the width of 297 mm are not passed through the fixing device 100 for which the A4/A3 width (297 mm) is set, so that it is possible to make setting so as not to generate the edge damage inside the region of the width of 297 mm. This setting is automatically limited on the basis of information of the size storing region 703, and therefore the user is free of worry that an unintended edge damage generates even when setting of what exclusive width is made for the fixing device is not recorded. However, at a proper position of the fixing device 100 for which the exclusive width setting is made, a discriminating member 130 (FIG. 3) having writing corresponding to the information is provided, so that the fixing device for which the exclusive width setting is made can be easily selected.

(Exchange Parts Counter)

The number of passed sheets with the image forming operation of the image forming apparatus is counted by a count function portion (counter). The controller 700 sends and updates (renews) the count information into the counter storing region 704 of the memory 117 of the fixing device 100 mounted in the mounting portion 50 of the apparatus main assembly 1A. As a result, in the counter storing region 704, the integrated value (exchange parts counter) of the number of passed sheets until then corresponding to each of various parts required to be periodically exchanged in the image forming apparatus 1 or the fixing device 100 is recorded while being updated.

Figure 6:
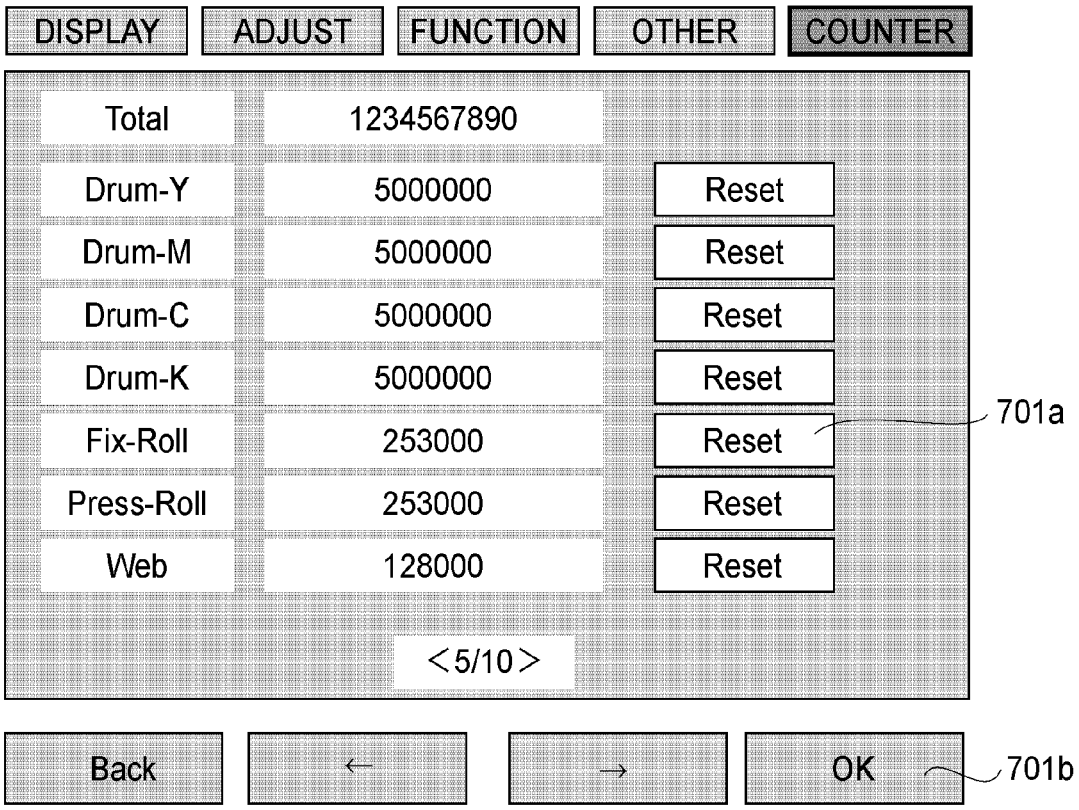
FIG. 6 is an illustration of a counter display screen of exchange (replacement) parts displayed at the display portion of the operating portion.

The operator (user or service person) reads information from the counter storing region 704 of the memory 117 in real at the display portion 701A of the operating portion 701 through the screen selection operation, and then can display the counter display screen of the respective exchange parts as shown in FIG. 6.

In the counter display screen of the respective exchange parts in FIG. 6, "Total" is an integrated value of all the passed sheets until then with respect to the image forming apparatus main assembly 1A. "Drum-Y", "Drum-M", "Drum-C" and "Drum-K" are integrated values of the number of passed sheets until then with respect to the photosensitive members 3Y, 3M, 3C and 3K, respectively, as the exchange parts in the image forming portions 2Y, 2M, 2C and 2K, respectively.

Further, "Fix-Roll", "Press-Roll" and "Web" are integrated values of the number of passed sheets until then with respect to the fixing roller 101, the pressing roller 102 and the web cleaning device 114, respectively, as the exchange parts in the fixing device 100.

The operator (user or service person) discriminates whether or not the exchange is required, from the integrated value of the number of passed sheets with respect to each of the various exchange parts displayed on the counter display screen for the respective exchange parts, and then performs an operation for exchanging a required part with a new one.

When the fixing roller 101 is periodically exchanged with a new one, the operator operates this screen, and pushes a reset button 701*a* and then pushes an OK button 700, so that the exchange parts counter is reset to "0".

When the exchange parts counter for the fixing roller 101 is reset, the controller 700 automatically shifts the screen display at the display portion 701A of the operating portion 701 from the screen of FIG. 6 to the sheet width setting screen for the fixing device shown in (a) of FIG. 4. As a result, the operator is prompted to change the exclusive width setting for the fixing device 100 in which the fixing roller 101 is exchanged. At this time, the fixing roller 101 is exchanged with the new one, and therefore the exclusive width can be selected/designated as any width.

This is summarized as follows. The size of the sheet capable of being introduced into the fixing device 100 is settable from the operating portion 701. The controller 700 records, in the memory 117, the integrated value of the number of introduced sheets with respect to each of the parts required to be periodically exchanged in the fixing device. The recorded integrated value can be reset by the operating portion 701. A set value of the size of the sheet capable of being introduced into the fixing device 100 is capable of being changed only when the part is exchanged and then the integrated value for the part before the exchange is reset (the operation screen is automatically shifted from the screen of FIG. 6 to the screen of (a) of FIG. 4).

As described above, the general purpose fixing device having the common specifications can be limited in a use of the image forming apparatus (fixing device) correspondingly to the user's needs. Accordingly, for the user requiring a high level with respect to the glossiness, it becomes possible to output an image high in degree of satisfaction.

Further, use limitation information of the fixing device is recorded and held in the memory mounted in the fixing device. For that reason, in such a situation that a plurality of fixing devices different in exclusive width setting are alternately replaced in the image forming apparatus, it becomes possible to output a high-quality image without causing confusion.

Incidentally, e.g., in the case where plain paper low in glossiness is used as the sheet P and a text document is printed, even when the edge damage generates on the fixing roller 101, there is little influence on the image. For this reason, in the case where the size information is not recorded in the size storing region 703, it is also possible to pass the sheets P having all the widths through the fixing device 100.

As described above, Embodiments according to the present invention were specifically described, but various constitutions can be changed to other constitutions within the scope of the concept of the present invention.

For example, the image forming apparatus 1 is not limited to the color image forming apparatus, but may also be a monochromatic (single color) image forming apparatus for a monochromatic image or the like.

For example, the fixing device 100 can also have a fixing device using an endless belt having flexibility as either one or both of the pair of rotatable members for forming the nip for fixing the toner image on the sheet by heat and pressure.

Further, e.g., the heating mechanism for the fixing device is not limited to the halogen heater, but can also employ other appropriate heating mechanism of a ceramic heater type or an electromagnetic induction heating type.

Incidentally, in the above-described embodiment, in the sheet size selection screen (FIG. 5), a constitution in which the selection of the sheet which does not coincide with the exclusive width cannot be made is employed, but e.g., control as shown below may also be effected. That is, controller effects control so that sheets having any widths can be selected in the sheet size selection screen, while the controller prohibits the image forming operation in the case where the sheet having the width which does not coincide with the exclusive width is selected in the sheet size selection screen. In this case, when the sheet having the width which coincides with the exclusive width is selected in the sheet size selection screen, the image forming operation is permitted.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Applications Nos. 2014-111046 filed on May 29, 2014, and 2015-076664 filed on Apr. 3, 2015, which are hereby incorporated by reference herein in its entirety.

What is claimed is:

1. An image forming apparatus comprising:

an image forming portion configured to form an image on a sheet;

a fixing portion configured to fix the image formed by said image forming portion on the sheet;

an operating portion including a display portion and configured to receive a selection of choices from an operator;

a display controller configured to control said display portion to display the choices indicative of a plurality of widths of the sheet, one of which is selectable by the operator; and an operation controller configured to determine whether to permit or prevent an execution of an image forming operation using said fixing portion, wherein, when one of the choices is selected, said operation controller permits the image forming operation on the sheet having the selected width on said display portion, using said fixing portion, and prevents the image forming operation on the sheet having a width different from the selected width, using said fixing portion, and wherein, when none of the choices is selected, said operation controller permits the image forming operation on the sheet for which said image forming apparatus is operable using said fixing portion, irrespective of the width of the sheet.

2. An apparatus according to claim 1, wherein, when one of the choices is selected, said operation controller permits execution of the image forming operation using said fixing portion only on a sheet having the selected width.

3. An apparatus according to claim 1, further comprising a storing portion configured to store, when one of the choices is selected, information corresponding to the selected width.

4. An apparatus according to claim 3, wherein said fixing portion is replaceable with another fixing portion, and each of said fixing portions is provided with said storing portion.

5. An apparatus according to claim 3, further comprising a writing portion configured to write new information corresponding to the width of the sheet in said storing portion, wherein, when said storing portion stores the information corresponding to the selected width, said writing portion writes the new information in said storing portion only when the new information corresponds to a width smaller than the selected width.

6. An apparatus according to claim 3, wherein, when the information corresponding to the selected width is stored in said storing portion, said display controller permits selection of the choice corresponding to a width smaller than the selected width currently stored in said storing portion, and prevents selection of the choice corresponding to a width larger than the selected width currently stored in said storing portion.

7. An apparatus according to claim 5, wherein, when said storing portion stores the new information, said operation controller permits execution of the image forming operation using said fixing device on the sheet having a width corresponding to the stored new information, and prevents the execution of the image forming operation using said fixing device on a sheet having a width different from that corresponding to the stored new information.

8. An apparatus according to claim 6, wherein said fixing portion includes a fixing rotatable member and an opposing rotatable member, and wherein, when said fixing rotatable member is replaced with a fresh fixing rotatable member, said display controller permits selection of the choice corresponding to any of the plurality of widths of the sheet that said image forming apparatus is capable of processing for the image forming operation.

9. A control device for an image forming apparatus, the image forming apparatus including an image forming portion configured to form an image on a sheet, a fixing portion configured to fix the image formed by the image forming portion on the sheet, and an operating portion including a display portion and configured to receive an instruction from an operator, said control device comprising:

a display controller configured to control the display portion to display the choices indicative of a plurality of widths of the sheet, one of which is selectable by the operator; and an operation controller configured to determine whether to permit or prevent an execution of an image forming operation using the fixing portion, wherein, when one of the choices is selected, said operation controller permits the image forming operation on the sheet having the width selected on the display portion, using the fixing portion, and prevents the image forming operation on the sheet having a width different from the selected width, using the fixing portion, and wherein, when none of the choices is selected, said operation controller permits the image forming operation on the sheet for which the image forming apparatus is operable using the fixing portion, irrespective of the width of the sheet.

10. A control device according to claim 9, wherein, when one of the choices is selected, said operation controller permits execution of the image forming operation using the fixing portion only on a sheet having the selected width.

11. A control device according to claim 9, further comprising a storing portion configured to store, when one of the choices is selected, information corresponding to the selected width.

12. A control device according to claim 11, further comprising a writing portion configured to write new information corresponding to the width of the sheet in said storing portion, wherein, when said storing portion stores the information corresponding to the selected width, said writing portion writes the new information in said storing portion only when the new information corresponds to a width smaller than the selected width.

13. A control device according to claim 12, wherein, when said storing portion stores the new information, said operation controller permits execution of the image forming operation using the fixing device on the sheet having the width corresponding to the stored new information, and prevents the execution of the image forming operation using the fixing device on a sheet having a width different from that corresponding to the stored new information.

14. A control device according to claim 13, wherein, when the information corresponding to the selected width is stored in said storing portion, said display controller permits selection of the choice corresponding to a width smaller than the selected width currently stored in said storing portion, and prevents selection of the choice corresponding to a width larger than the selected width currently stored in said storing portion.

15. A control device according to claim 9, wherein the fixing portion is replaceable with another fixing portion, and each of the fixing portions is provided with a storing portion configured to store, when one of the choices is selected, information corresponding to the selected width.

16. A control device according to claim 9, wherein the fixing portion includes a fixing rotatable member and an opposing rotatable member, and wherein, when the fixing rotatable member is replaced with a fresh fixing rotatable member, said display controller permits selection of the choice corresponding to any of the plurality of widths of the sheet that the image forming apparatus is capable of processing for the image forming operation.

17. An image forming apparatus comprising:

an image forming portion configured to form an image on a sheet;

a fixing portion including a fixing rotatable member and an opposing rotatable member and configured to fix the image formed by said image forming portion on the sheet;

a storing portion configured to store restricting information corresponding to a width of the sheet;

a controller configured to control an image forming operation using said fixing portion on the basis of the restricting information stored in said storing portion, wherein said controller permits the image forming operation using said fixing portion on the sheet having the width stored in said storing portion, and prevents the image forming operation using said fixing portion on the sheet having a width smaller than that stored in said storing portion; and a writing portion configured to write new restricting information in said storing portion, wherein, unless said fixing rotatable member is fresh, said writing portion only writes the new restricting information corresponding to the width of the sheet that is smaller than that currently stored in said storing portion, as the new restricting information.

18. An apparatus according to claim 17, wherein, when said storing portion stores the new restricting information, said controller permits execution of the image forming operation using said fixing portion on the sheet having the width corresponding to the new restricting information stored in said storing portion, and prevents execution of the image forming operation using said fixing portion on the sheet having a width smaller than that corresponding to the new restricting information stored in said storing portion.

19. An apparatus according to claim 17, further comprising:

an operating portion including a display portion and configured to receive selection of choices from an operator;

a display controller configured to control said display portion to display the choices indicative of a plurality of widths of the sheet, one of which is selectable by the operator, wherein, unless said fixing rotatable member is fresh, said display controller permits selection of a width smaller than the width stored in said storing portion, and prevents selection of a width larger than the width stored in said storing portion, and wherein said writing portion writes the new restricting information corresponding to the width of the sheet selected on said operating portion in said storing portion.

20. An apparatus according to claim 19, wherein, when said fixing rotatable member is replaced with a fresh fixing rotatable member, said display controller permits selection of a width larger than that currently stored in said storing portion, and said writing portion is capable of writing the new restricting information corresponding to a width larger than that corresponding to the currently stored information.

21. An apparatus according to claim 17, wherein said fixing portion is replaceable with another fixing portion, and each of said fixing portions is provided with said storing portion.

22. An apparatus according to claim 17, wherein, when said fixing rotatable member is replaced with a fresh fixing rotatable member, said writing portion permits to write information corresponding to a width larger than that currently stored in said storing portion, as the new restricting information.

23. A control device for an image forming apparatus, the image forming apparatus including an image forming portion configured to form an image on a sheet, and a fixing portion including a fixing rotatable member and an opposing rotatable member, and configured to fix the image formed by the image forming portion on the sheet, said control device comprising:

a storing portion configured to store restricting information corresponding to a width of the sheet;

a controller for controlling an image forming operation using the fixing portion on the basis of the restricting information stored in said storing portion, wherein said controller permits the image forming operation using the fixing portion on the sheet having the width stored in said storing portion and prevents the image forming operation using the fixing portion on the sheet having a width smaller than that stored in said storing portion; and a writing portion configured to write new restricting information in said storing portion, wherein, unless the fixing rotatable member is fresh, said writing portion only writes the new restricting information corresponding to a width of the sheet smaller than that currently stored in said storing portion, as the new restricting information.

24. A control device according to claim 23, wherein, when said storing portion stores the new restricting information, said controller permits execution of the image forming operation using the fixing portion on the sheet having the width corresponding to the new restricting information stored in said storing portion, and prevents execution of the image forming operation using the fixing portion on the sheet having a width smaller than that corresponding to the new restricting information stored in said storing portion.

25. A control device according to claim 23, wherein the image forming apparatus further comprises an operating portion including a display portion and configured to receive an instruction from an operator, wherein said control device further comprises a display controller configured to control the display portion to display the choices indicative of a plurality of widths of the sheet, one of which is selectable by the operator, wherein, unless the fixing rotatable member is fresh, said display controller permits selection of a width smaller than the width stored in said storing portion and prevents selection of a width larger than the width stored in said storing portion, and wherein said writing portion writes the new restricting information corresponding to the width of the sheet selected on the operating portion in said storing portion.

26. A control device according to claim 25, wherein when the fixing rotatable member is replaced with a fresh fixing rotatable member, said display controller permits selection of a width larger than that currently stored in said storing portion, and said writing portion is capable of writing the new restricting information corresponding to a width larger than that corresponding to the currently stored information.

27. A control device according to claim 23, wherein, when the fixing rotatable member is replaced with a fresh fixing rotatable member, said writing portion is permitted to write information corresponding to a width larger than that currently stored in said storing portion, as the new restricting information.

28. An image forming apparatus comprising:

an image forming portion configured to form an image on a sheet;

a fixing portion configured to fix the image formed by said image forming portion on the sheet and including a storing portion configured to store information, wherein said fixing device is detachably mounted in said image forming apparatus;

an operating portion including a display portion and configured to receive selection of choices from an operator;

a display controller configured to control said display portion to display the choices indicative of a plurality of widths of the sheet, one of which is selectable by the operator; and an operation controller configured to determine whether to permit or prevent an execution of an image forming operation using said fixing portion, wherein said storing portion stores information corresponding to a width of a sheet which is selected from the choices on said display portion; and wherein said operation controller permits the image forming operation on the sheet having the width indicated by the information stored in said storing portion, using said fixing portion, and prevents the image forming operation on the sheet having a width different from the width indicated by the information stored in said storing portion, using said fixing portion.

29. An apparatus according to claim 28, wherein said operation controller permits execution of the image forming operation using said fixing portion only on a sheet having the width indicated by the information stored in said storing portion.

* * * * *